US005212522A

United States Patent [19]

Knapp

[11] Patent Number: 5,212,522

[45] Date of Patent: May 18, 1993

[54] BASIC DEVELOPABILITY CONTROL IN SINGLE COMPONENT DEVELOPMENT SYSTEM

[75] Inventor: John F. Knapp, Fairport, N.Y.

[73] Assignee: Xerox Corporation, Stamford, Conn.

[21] Appl. No.: 906,090

[22] Filed: Jun. 29, 1992

[51] Int. Cl.[5] ..... G03G 15/08

[52] U.S. Cl. ..... 355/208; 355/246

[58] Field of Search ..... 355/208, 246, 259

[56] References Cited

U.S. PATENT DOCUMENTS

| | | | |
|---|---|---|---|
| 4,026,643 | 5/1977 | Bergman | 355/3 DD |
| 4,459,009 | 7/1984 | Hays et al. | 355/3 DD |
| 4,505,573 | 3/1985 | Brewington et al. | 355/3 DD |
| 4,868,600 | 9/1989 | Hays et al. | 355/259 |
| 4,876,575 | 10/1989 | Hays | 355/259 |
| 4,967,231 | 10/1990 | Hosoya et al. | 355/259 X |
| 4,984,019 | 1/1991 | Folkins | 355/215 |
| 5,005,050 | 4/1991 | Donivan et al. | 355/208 |
| 5,006,897 | 4/1991 | Rimai et al. | 355/246 |
| 5,040,021 | 8/1991 | Fowlkes | 355/203 |
| 5,047,802 | 9/1991 | Donivan et al. | 355/208 |
| 5,083,161 | 1/1992 | Borton et al. | 355/208 |

FOREIGN PATENT DOCUMENTS

| | | | |
|---|---|---|---|
| 60-130773 | 7/1985 | Japan | 355/246 |

OTHER PUBLICATIONS

Japan Patent No. 3-276174, Katsuhiro Aoki, "Developing Device for Image Forming Device", Jun. 12, 1991 (Abstract).

*Primary Examiner*—Joan H. Pendegrass
*Attorney, Agent, or Firm*—R. Hutter

[57] ABSTRACT

In the development system of an electrophotographic apparatus, a selected ratio of electrostatic charge per unit mass for particles adhering to a member transporting to a surface having a latent image recorded thereon is maintained. Means are provided for controlling a ratio of particle mass to the member surface area, and such means are controlled as a function of the selected ratio of electrostatic charge to unit mass to regulate the ratio of particle mass to the member surface area so as to substantially maintain particle electrostatic charge to unit mass ratio at the selected ratio of electrostatic charge to unit mass.

14 Claims, 7 Drawing Sheets

BASIC DEVELOPABILITY CONTROL IN SINGLE COMPONENT DEVELOPMENT SYSTEM

FIELD OF THE INVENTION

The present invention relates to developer apparatus for xerography. More specifically, the invention relates to a system for controlling the charge per unit mass of toner conveyed to a photoreceptor as part of the development process.

BACKGROUND OF THE INVENTION

In the well-known process of xerography, or electrophotographic printing, a charge retentive surface, known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. The brush is brought into contact with the imagewise-charged photoreceptor, and the toner particles move from the chains of carrier beads to adhere to the photoreceptor.

Another known development technique involves a single-component developer material. In a typical single-component development system, each toner particle has both magnetic properties (to allow the particles to be magnetically conveyed to the photoreceptor) and an electrostatic charge (to enable the particles to adhere to the photoreceptor). In such a system, the developer roll is in the form of a cylindrical sleeve which rotates about a stationary magnet assembly. Thus, magnetized toner particles adhere to the rotating sleeve by the force of the stationary magnets within the sleeve, and as the sleeve rotates around the magnets, particles adhering to the sleeve will be exposed to an alternating series of magnetic polarities. A metering blade is typically in continuous contact with the toner particles on the sleeve along one longitude of the developer roll, so that the toner particles will adhere to the moving sleeve in a thin, uniform coating. When this thin layer of particles is obtained, the developer roll advances the toner particles to a development zone adjacent the surface of the photoreceptor. In the development zone, the toner particles adhering magnetically to the developer roll are attracted electrostatically to the latent image recorded on the photoreceptor. With this technique, toner particles may be evenly distributed on the charged areas of the latent image. Systems in which the toner particles are caused to adhere to the devloper roll by other than magnetic forces, such as electroststaic forces, are also known.

An important variation to the general principle of single-component development is the concept of "scavengeless" development. The purpose and function of scavengeless development is described more fully in, for example, U.S. Pat. No. 4,868,600 or U.S. Pat. No. 4,984,019. In a scavengeless development system, toner is conveyed to the photoreceptor by means of AC electric fields supplied by self-spaced electrode structures positioned within the nip between a donor roll and photoreceptor. The electrode structure, commonly in the form of wires extending adjacent to and across the photoreceptor, is placed in close proximity to the donor roll within the gap between the donor and the photoreceptor. Generally, this type of development is useful for devices in which different types of toner are supplied onto the same photoreceptor, as in tri-level or "highlight" xerography.

A typical scavengeless development apparatus includes, within a developer housing, a donor roll disposed adjacent the photoreceptor. In the nip between the donor roll and the photoreceptor are wires forming the electrode structure. During development of the latent image of the photoreceptor, the electrode wires are electrically biased relative to the donor roll, to detach toner therefrom to form a toner powder cloud in the gap between the donor roll and the photoreceptor. The charged areas on the photoreceptor corresponding to the latent image electrostatically attract toner particles from the powder cloud, forming a toner powder image thereon.

For both scavengeless and regular types of single-component development, another proposed apparatus for placing an even layer of electrostatically charged toner particles on the surface of a developer roll is a charge rod. The general principle of the charge rod is described in U.S. Pat. No. 4,459,009, as well as in U.S. Pat. No. 4,505,573 and U.S. Pat. No. 4,876,575. In essentials, an electrically biased charge rod is used in place of the metering blade against the surface of the developer roll, and serves not only to regulate the thickness of the layer of toner particles on the developer roll, but also to impart an electrostatic charge to the toner particles. Typically, the charge rod rotates in a direction against that of the surface of the developer roll.

In any kind of developing system, one of the most important considerations is the electrostatic charge per unit mass of the toner particles, known as "q/m." The specific value of q/m under given conditions has a substantial effect on the ultimate image quality of prints made with the apparatus. Generally speaking, the q/m for toner particles in a development process must be within a certain range for acceptable print quality. If the q/m is above this range, the toner particles will require more force to "jump" from the developer roll to the photoreceptor in the developing step, and in the transfer step, more force will be required to cause the particles to transfer from the photoreceptor to paper. Alternatively, a too low q/m will increase the likelihood that toner particles will adhere even to relatively discharged areas on the photoreceptor and appear in background areas of finished prints, causing a "dirty" appearance to the print. In a two-component developer system, the q/m of the toner may be relatively easily controlled, to a degree, by controlling the ratio of toner particles to carrier particles in the developer mixture. However, this straightforward technique is not possible with a single-component developer system.

In the prior art there are many proposed techniques for determining the q/m of toner particles in the course of the xerographic process. U.S. Pat. No. 4,026,643 discloses and apparatus and method wherein q/m is determined by combining a measurement of the difference between the photoreceptor potential in the presence and in the absence of charged toner particles with a measurement of a difference in optical reflectance in the presence and in the absence of charged toner particles. The measurement of the difference in the electrostatic potential of the photoreceptor provides a quantity proportional to the toner particle charged per unit area. The measurement of the difference in optical reflectance provides a quantity related to the toner mass per unit area, a quantity that is linear for low particle densities. Combining the two difference measurements provides a value proportional to the q/m of the toner.

U.S. Pat. No. 5,005,050 discloses an apparatus for controlling q/m. A pair of electrometer probes measure the potential of the photoreceptor before and after development. The output of the electrometers are compared at a difference network, and the difference between the signals is proportional to the amount of charge deposited on the belt due to movement of toner particles from the development station to the photoreceptor surface. The q/m is then adjusted by means of ions directed to the toner particles. U.S. Pat. No. 5,047,802 describes a variation of this technique.

U.S. Pat. No. 5,006,897 discloses a piezo device positioned to interact with toner particles. The device is periodically electrically biased to attract toner particles, and the frequency shift of the piezo device due to the mass of attracted toner particles is detected. By appropriately measuring the electrical characteristics of a capacitive circuit, the charge of toner particles on the developer mixture positioned between two capacitive plates can be determined. In this way, the q/m of toner particles may be measured in the course of a xerographic process.

U.S. Pat. No. 5,040,021 discloses a densitometer for determining the optical density of toner on a photoconductive layer by exposing the photoreceptor to radiation through the toner layer such that the amount of exposure is characteristic of the density of the toner layer. The change of voltage on the surface of the toner layer caused by the exposures detected such that the change in detected voltage is characteristic of the density of the toner layer. The measurement of the change in the detected voltage is carried out by measuring the characteristic voltage on a toner layer, discharging the characteristic voltage on the photoreceptor, and then measuring the remaining voltage.

JP-A-3-276174 discloses a system for controlling the quantity of toner material on a "replenisher roll." A photosensor detectes the desnity of toner material on the surface of the roll, and in response thereto, the position of a metering blade is adjusted to vary the quantity of toner on the roll. In this reference no suggestion is made of a relationship between the mere density of toner on the surface and the charge per unit mass of the toner.

SUMMARY OF THE INVENTION

The present invention relates to an apparatus and method for maintaining a selected ratio of electrostatic charge per unit mass for particles adhering to a member transporting to a surface having a latent image recorded thereon. Means are provided for controlling a ratio of particle mass to the member surface area, and such means are controlled as a function of the selected ratio of electrostatic charge to unit mass to regulate the ratio of particle mass to the member surface area so as to substantially maintain particle electrostatic charge to unit mass ratio at the selected ratio of electrostatic charge to unit mass.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 7:
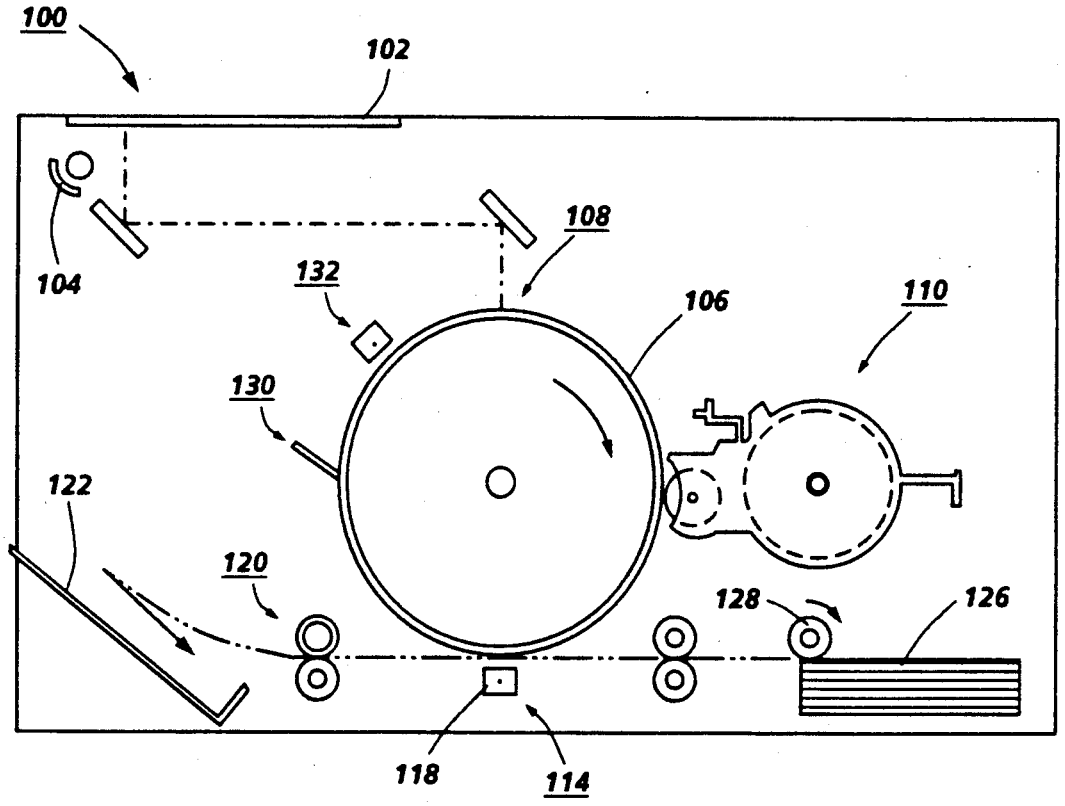
FIG. 7 PRIOR ART
FIG. 7 is an elevational view showing the basic elements of a typical electrophotographic printer.

FIG. 7 shows the basic elements of a typical electrophotographic printer, shown generally by reference numeral 100. In electrophotographic printer 100, a document to be reproduced is placed on a platen 102 where it is illuminated in known manner by a light source such as a tungsten halogen lamp 104. The document thus exposed is imaged onto the photoreceptor 106 by a system of mirrors, as shown. The source of the original image to be printed may alternatively be a read output scanner (ROS), wherein a laser source moving across the photoreceptor selectively discharges the photoreceptor in accordance with digital image data. In the example copier shown, the photoreceptor 106 is in the form of a rotating drum, although photoreceptors in the form of a belt are also known, and may be substituted therefor for purposes of the present invention. The optical image selectively discharges the surface of photoreceptor 106 in an image configuration whereby an electrostatic latent image of the original document is recorded on the drum 106 at imaging station 108. The photoreceptor drum 106 rotates so that the latent image is moved towards development station 110, where the electrostatic latent image is developed, by the application of toner particles, into visible form. In the case of a single-component development system, toner from a supply hopper is gradually conveyed by means of a rotating developer roll to the latent image recorded on photoreceptor drum 106. The details of the operation of the development station 110 will be described hereinafter.

The developed image is transferred at the transfer station 114 from the photoreceptor drum 106 to a sheet of copy paper, which is delivered from a paper supply system into contact with the drum 106 in synchronous relation to the image thereon. At the transfer station 114, a transfer corotron 118 provides an electric field to assist in the transfer of the toner particles from the photoreceptor drum 106 to the copy sheet. Individual sheets are introduced into the system from a stack of supply paper 126 by a friction feeder 128. A separated sheet from stack 126 is fed, in the embodiment shown, by further sets of nip roll pairs through a path indicated by the broken line. The image is subsequently fused onto the paper in known manner at fusing station 120 and the finished copy is deposited in hopper 122. After the toner on the drum 106 is transferred to the paper, residual toner is removed from the surface of the photoreceptor drum 106, for example by cleaning blade 130, and then the surface is recharged, as by charging corotron 132, for imagewise discharging of the photoreceptor in the next cycle.

Figure 8:
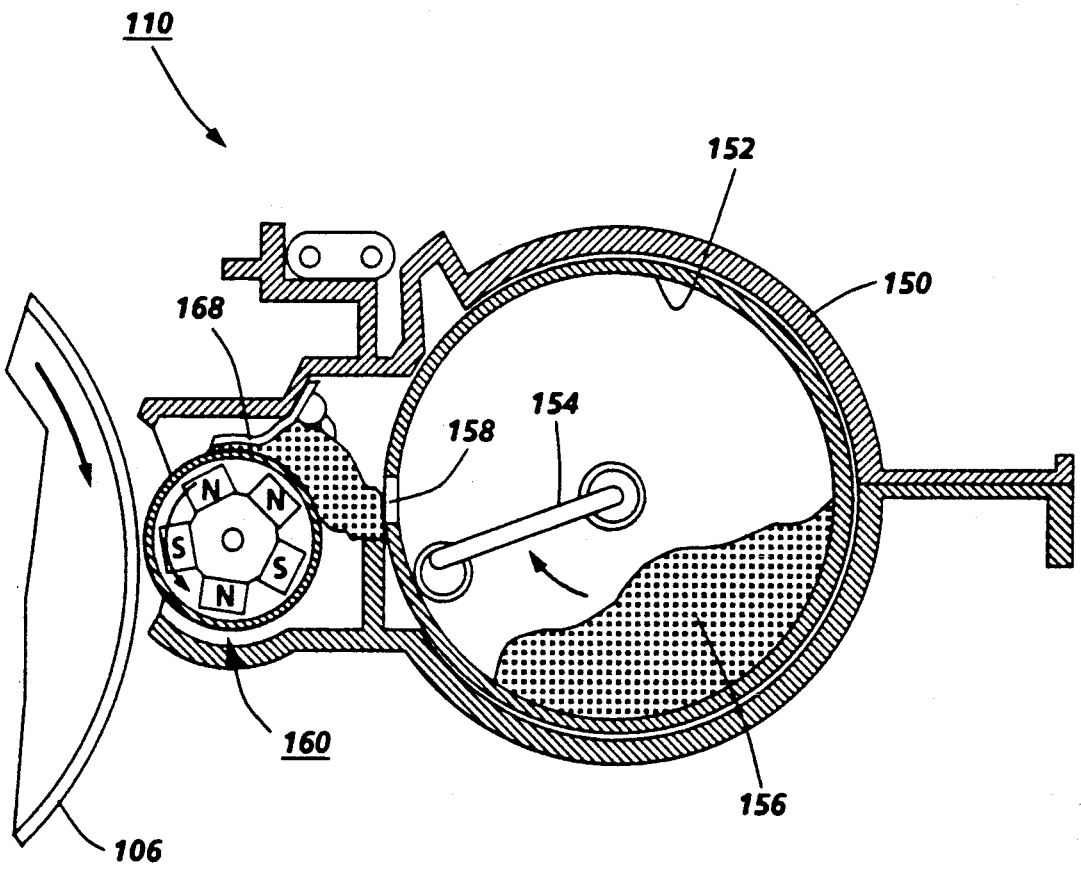
FIG. 8 PRIOR ART
FIG. 8 is a sectional, elevational view showing a detail of the developer apparatus of the electrophotographic printer shown in FIG. 7.

FIG. 8 shows a typical single-component developer station, generally indicated by reference numeral 110. As typically constructed for a commercial application, the main body of developer station 110 is encased in a developer housing 150. The main part of the developer housing is, in this commercial embodiment, in the form of an enclosed cylindrical space which accommodates a cylindrical toner cartridge 152, shown in cross section. The toner cartridge 152 is typically in the form of a customer-replaceable unit (CRU), and made of an inexpensive material such as cardboard or aluminum. The toner cartridge 152 is preferably cylindrical so that it may be slid easily into the developer housing. It is typical that a CRU toner cartridge 152 may include an inexpensive rotatable agitator 154, which engages a rotating member in the copier. The purpose of agitator 154 is generally to keep the single-component developer (toner) well-mixed and aerated, so that the toner 156 will flow easily and will not coagulate in one area of the toner cartridge 152. Such an agitator 154 may also be useful in moving toner particles out of the toner cartridge 152 at a consistent rate.

No matter what the specific design of the toner cartridge 152, such a cartridge will include at least one opening 158 defined therein, in order that the toner 156 may be gradually taken out of the toner cartridge 152. In the design shown, opening 158 is in the form of one or more openings along a longitudinal axis of the cylindrical toner cartridge 152, the opening 158 being oriented adjacent developer roll 160. In this way, toner 156 may be gradually removed from the toner cartridge 152 and conveyed by the developer roll 160 to the surface of photoreceptor 106.

The elements of a developer roll 160 in a single-component development system are a stationary magnet assembly 162, enclosed within a rotating cylindrical sleeve 164. Stationary magnet assembly 162 includes a plurality of permanent magnets, with each magnet extending substantially the length of the developer roll 160, and being arranged so that a selected pole of each magnet is exposed outward. The alternating polarities of the magnets create magnetic flux lines which extend outward toward the outer surface of the sleeve 164. In a typical single-component developer system, the toner particles have magnetic properties associated therewith, for example by virtue of a significant iron content, but generally no specific magnetic polarity. The magnets on magnetic assembly 162 generally cause the toner particles to adhere to the surface of outer sleeve 164, and the rotation of outer sleeve 164 causes the toner particles to, in effect, move around the developer roll 160 from the toner cartridge side of the developer roll 160 to a development zone adjacent the surface of the photoreceptor 106.

Metering blade 168 is typically an angled, somewhat resilient blade urged against the surface of the developer roll 160 along a longitude thereof. In a typical development apparatus, the purpose of the metering blade 168 is to smooth out the layer of toner particles on the sleeve 164 so that the layer will be uniform when it is brought into contact with the photoreceptor 106. In the present invention, metering blade 168 also has the function of controlling the mass of toner per unit area on the sleeve 164, as will be explained in detail below.

Figure 1A:
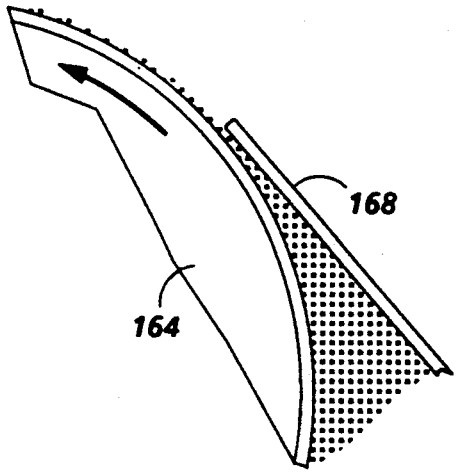
FIGS. 1A, 1B, and 1C are comparative elevational views showing the interaction of toner particles with the sleeve of a developer roll and a metering blade for three levels of thickness of the toner particles layer.
Figure 1B:
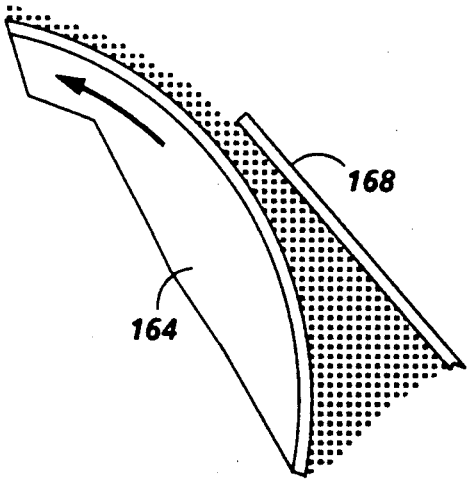
Figure 1C:
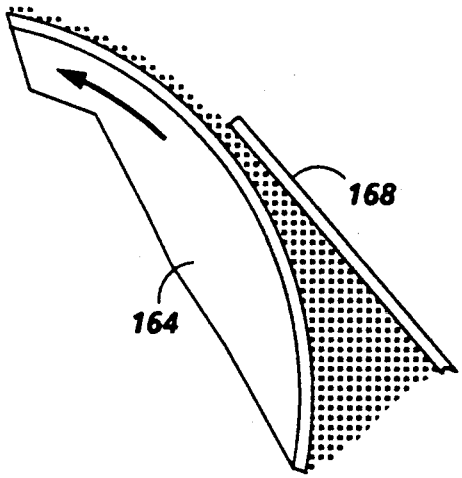
Figure 2B:
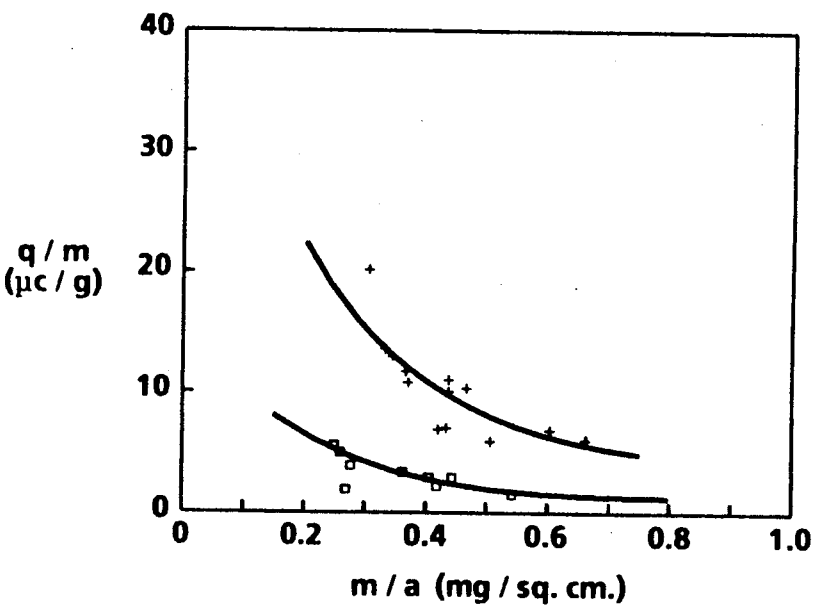
FIGS. 2A, 2B, 2C, and 2D are graphs showing the relationship between q/m and m/a for a variety of example types of toner material.
Figure 2A:
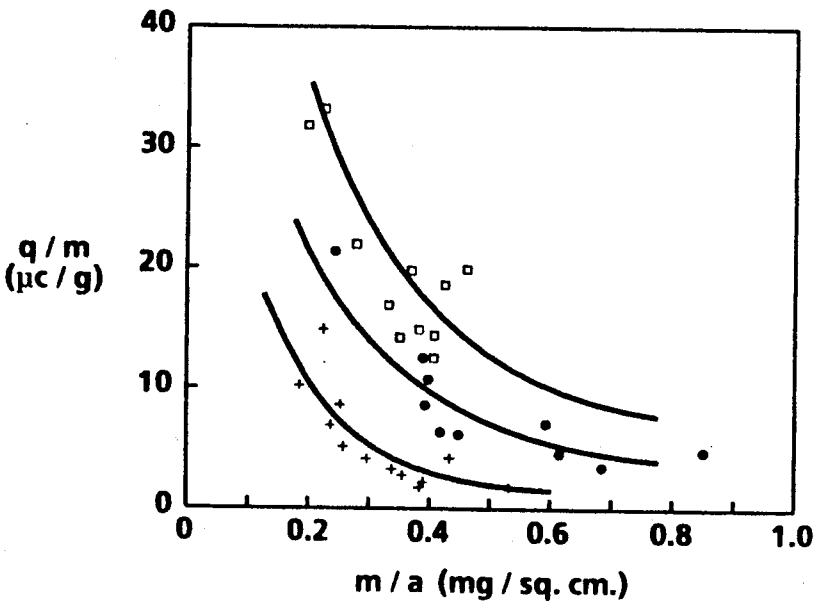
Figure 2C:
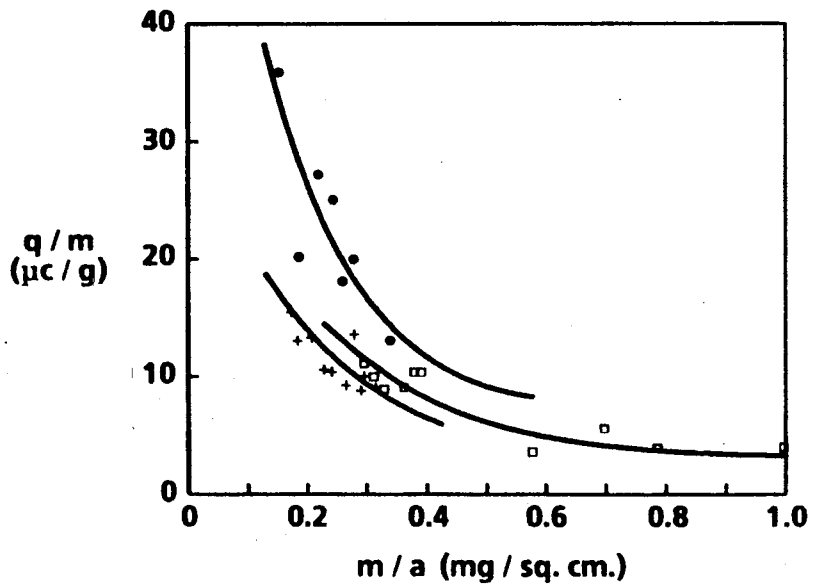
Figure 2D:
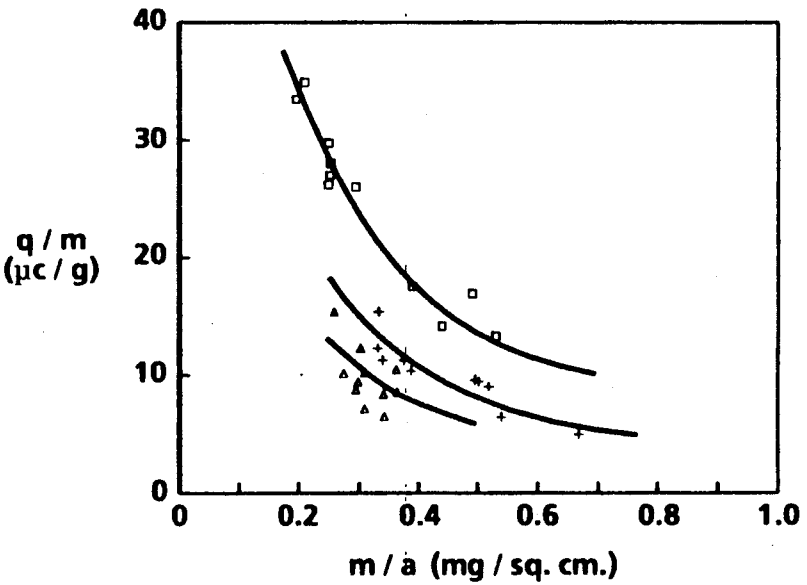

FIGS. 1A, 1B, and 1C are a series of detailed views showing a comparison of behaviors of toner particles under different conditions of pressure between the sleeve 164 of developer roll 160, and metering blade 168. In the examples shown in FIGS. 1A, 1B, and 1C, the metering blade 168 is not electrically biased, as would be a charge rod, which will be described in detail below. In FIG. 1A, metering blade 168 is urged against a sleeve 164 of the developer roll to such an extent that only a very thin layer of toner particles, here shown for purposes of illustration only as a single layer, is ultimately disposed on the surface of the sleeve 164. In such a case, at least a large proportion of the toner particles will, in the course of metering, come into direct contact with either the sleeve 164 or the metering blade 168. As will become apparent below, the extent of this direct contact will have a substantial effect on the ultimate q/m of the toner particles when they reach the development zone adjacent photoreceptor 106. In FIG. 1B, the pressure of the metering blade 168 against sleeve 164 is very low in comparison to FIG. 1A, such that a relatively thick layer of toner particles, as shown, passes through the gap of metering blade 168 and sleeve 164. Here, it is important to note that only a relatively small proportion of the toner particles passing under metering blade 168 will actually come into direct contact with either sleeve 164 or metering blade 168. Most of the toner particles will simply remain in contact with other toner particles. As will be explained in detail below, this lack of physical contact will tend to create a situation in which the q/m of the metered toner particles on sleeve 164 will be very close to the pre-load q/m, that is, the q/m of toner particles as they were loaded onto the donor roll from the toner cartridge 152. In FIG. 1C is shown an intermediate case, where metering blade 168 is urged against sleeve 164 with slightly more pressure than in FIG. 1B but less than in FIG. 1A, and here some intermediate proportion of the toner particles come into direct contact with either sleeve 164 or metering blade 168.

An essential principle by which the present invention operates is that the q/m of toner particles under given conditions is a unique function of the mass of the toner per unit area, known as m/a, on the surface of a developer roll. The relationship between q/m and m/a is apparent even independently of the fact that the lower mass in the m/a ratio implies a greater value of the q/m ratio because the "m" in both terms is the same. It has been found that the contact of toner particles with outside surfaces, such as the metering blade 168 and the surface 164 of the developer roll, has a triboelectric effect and significantly affects on q/m. In general, q/m for a given quantity of toner increases by virtue of contact with outside surfaces, even if the outside surfaces (such as metering blade 168) are not themselves electrically biased. As mentioned above, if toner particles are not permitted to contact any other surface but other toner particles in the metering process, the q/m of the particles will not increase substantially in the course of metering onto a developer roll.

FIGS. 2A, 2B, 2C, and 2D are four example graphs, each curve on each graph representing a different example type of toner under certain conditions, showing in each graph the relationship between q/m (the y-axis of each graph) as a function of m/a (the x-axis of each graph). It is clear from these graphs that for many types of toner, the relationship of q/m as a function of m/a is a generally inverse one. According to the present invention, these functions, which may be empirically derived for the type of toner and conditions in question, can be exploited to control the ultimate value of q/m for optimal print quality.

Figure 3:
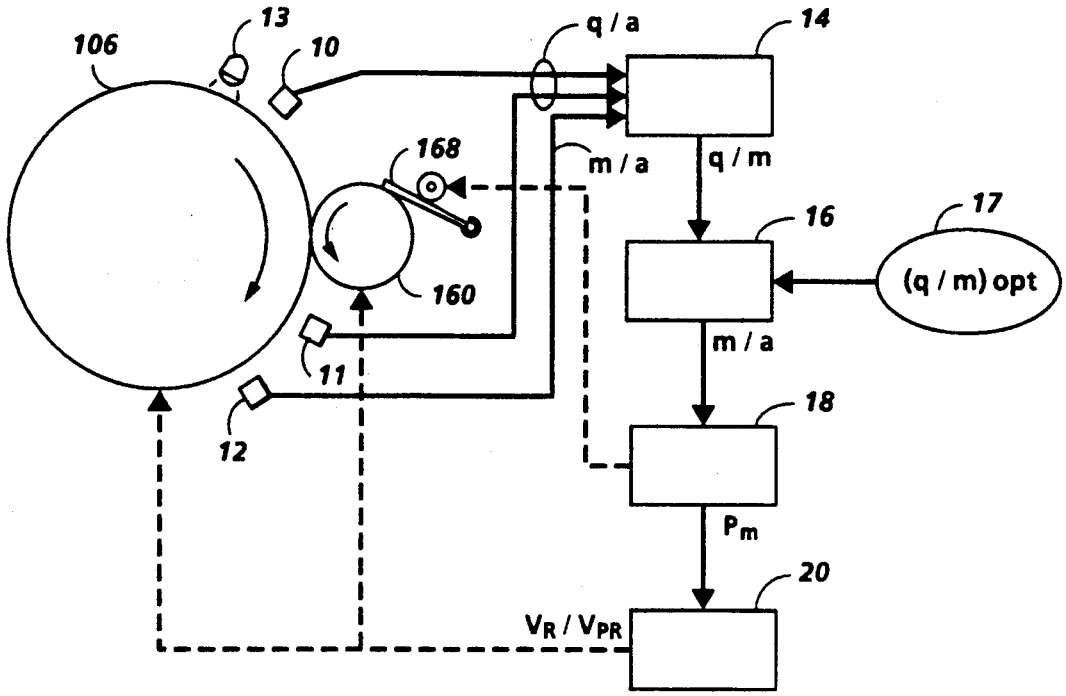
FIG. 3 is a systems diagram showing the operation of a control system according to the present invention.

There are several known techniques for determining the q/m of toner particles in the course of the xerographic process, and any of these may be adapted for use in conjunction with the present invention. For example, it may be possible to monitor the voltage and mass of toner per area on the developer roll to obtain the q/m. More preferably, the technique shown in U.S. Pat. No. 4,026,643, assigned to the assignee of the present invention, is suitable, and a systems diagram of a control system according to the present invention making use of this technique is shown in FIG. 3. The q/m measurement technique generally involves measuring the electrostatic potential on the photoreceptor before and after the development step in the xerographic process. In FIG. 3 is shown a selection of the relevant elements of the electrostatic printer as seen in FIG. 7, particularly photoreceptor 106 and developer roll 160, including a metering blade 168. In addition to the typical elements of an electrophotographic apparatus, there includes, for purposes of the present invention, a series of sensors disposed around photoreceptor 106. Electrometers 10 and 11 are disposed before and after developer roll 160, respectively, along the process direction of photoreceptor 106. The purpose of these electrometers is to measure the electrostatic potential on the surface of photoreceptor 106 before and immediately after the development step. There also includes an optical densitometer 12 disposed downstream of the developer roll 160 for optical determination of the density of toner on a selected region of photoreceptor 106. It is preferred that the selected region on the surrace of photoreceptor 106, which is inspected by densitometer 12, be a deliberately-created test patch disposed between image areas along the photoreceptor 106. One common apparatus for creating a test patch is a test patch source 13 which is adapted to apply a known charge to an area of the surface of photoreceptor 106 in the relevant area. Depending on the design of the system, source 13 may cause a charge or discharge of the test patch area between image areas on the photoreceptor 106, by, for example, shining light in or around the area of the test patch.

The relevant area of the charged surface of photoreceptor 106 is first passed near the electrometer 10. The electrometer 10, with its associated electronic circuits (not shown), measure the potential of the charged surface of the photoreceptor 106 prior to development.

The charged surface of photoreceptor 106 is next transported to the vicinity of developer roll 160. The toner particles transferred to the surface of the photoreceptor 106 have an electrostatic charge applied thereto of an opposite polarity from the charge of the surface of photoreceptor 106. Consequently, as the result of an electrostatic forces, toner particles from the developer apparatus adhere to the surface of the photoreceptor. An AC voltage may be applied between the developer roll 160 and the photoreceptor 106 to assist in development.

The surface of the photoreceptor 106, along with the electrostatically coupled toner particles thereon, are then passed in the vicinity of electrometer 11, which measures the electrostatic potential of the surface of photoreceptor 106 in the vicinity thereof. The presence of charged toner particles on the surface of photoreceptor 106 will neutralize a portion of the latent electrostatic charge, and the measurements resulting from the electrometers 10 and 11 will generally be different. The difference in electrostatic voltage between electrometers 10 and 11 will then be a measure of toner charge per unit area.

In addition to the measurement by electrometers 10 and 11, an optical density measurement is also performed by the apparatus of the preferred embodiment. A light source (not shown) illuminates the test patch region on the surface of photoreceptor 106. The reflected illumination radiation is focused onto a photodetector 12. Various techniques may be used at this stage to obtain the specific value of the reflectance of the toner particles on the surface, and such extra means may include further light sources and detectors. One possible densitometer which may be used in conjunction with the present invention is described in U.S. Pat. No. 5,083,161, assigned to the assignee of the present invention. This optical signal is a measure of the toner mass per unit area developed.

The output signals from electrometers 10 and 11 and optical detector 12 are entered into a data processing system, the first step of which is illustrated by box 14. Such a data processing system may be embodied in hardware, software, or both, in order to derive the desired values of relevant variables. The input into system 14 are the electrostatic potential readings from electrometers 10 and 11, respectively, and the optical signal from sensor 12. Electrometers 10 and 11 are coupled to a difference network, which is adapted to provide a signal determined by the effect of photoreceptor surface electrostatic potential. The respective measurements of electrostatic potential from electrometers 10 and 11 can be made either sequentially or continuously. The difference network, embodied in hardware, software, or both, outputs a value (either an analog signal, digital value, or some other manifestation) related to the difference in electrostatic potentials on the surface of photoreceptor 106 before and after the development step. The charge of the toner will be, in effect, the value of the change in electrostatic potential during the development step. The difference in electrostatic potential on the surface of photoreceptor 106 before and after the development step can be used to determine the charge associated with the toner which was applied to the surface of the photoreceptor in the development step, to obtain a value of charge per unit area on the photoreceptor 106. This value of charge per unit of developed area is q/a.

Also entered into system 14 are signals or values from the photodetector 12. It will be clear that additional photodetecting units may conceivably be employed to monitor a region of the surface of photoreceptor 106 to which toner particles are not attached, in order to obtain more accurate or precise readings. As the optical density of toner particles on a photoreceptor surface is directly related to the ratio of mass of toner particles per unit area on the surface, the output of photodetector 12 can then be converted to a usable value of massive toner per unit area, or m/a.

As q/a is known from the electrometer readings, and m/a from the optical densitometer 12, these two quantities can be used to derive the value of q/m, the variable of most interest. Once again, the mathematical steps required to derive q/m can be performed, for example, by analog computer or digital means.

The calculated value of q/m at a given time in the operation of the electrophotographic printer can then be compared to a desired optimal value of q/m consistent with desired print quality. This step is shown as box 16 in the systems diagram of FIG. 3. Such an optimal value of q/m may be stored in a look-up table such as that shown by 17 in FIG. 3. As noted above, too low of value of q/m for toner applied to a photoreceptor will result in lightness of printed areas, while too high a value of q/m will result in a "dirty" appearance to the print, where specious toner particles adhere two areas on the image which are intended to be white. The actual value of q/m from system 14 can then be compared to a preset optimal value 17, and the value of q/m can be adjusted accordingly. Such an optimal q/m value as in 17 may be fixed upon manufacture of the apparatus, or provision may be made to allow the user to adjust the q/m based on the user's own needs. According to the present invention, this automatic adjustment of q/m toward a selected optimal value is carried out by selecting a corresponding value of m/a. As noted above, the q/m of toner particles is a unique function of the mass per unit area, or m/a, on the surface of the developer roll 160.

Figure 4:
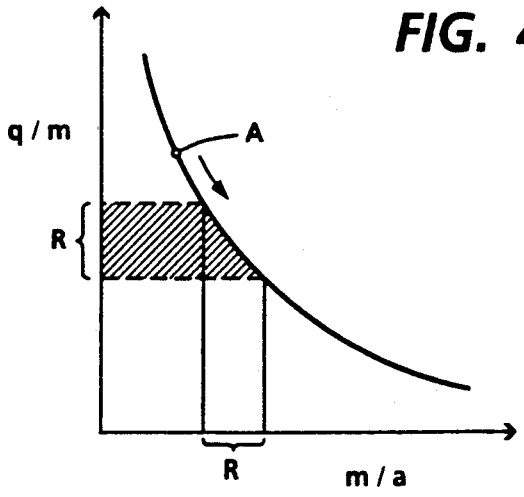
FIG. 4 is a graph showing the relationship between q/m and m/a for a hypothetical situation.

FIG. 4 is a graph showing a typical relationship between m/a and q/m for a given type of toner in a given type of electrophotographic apparatus. This relationship is a composite version of any of the various curves shown in FIG. 2, given for purposes of illustration. There will be a desirable range of values of q/m for a desired level of copy quality, and thus, using an empirical relationship such as in FIG. 4, for this desired q/m there will be necessary value of m/a. Thus, the purpose of system 16 is to exploit this unique relationship under given conditions to adjust q/m. For example, if the observed q/m from 14 is higher than the desired range R, such as at point A in FIG. 4, the system 16 can output a value of m/a which will serve to lower the q/m (by increasing the m/a) until the q/m is within a desired range R. Therefore, the output from system 16 will be a desired value of m/a to yield the desired q/m.

Figure 5:
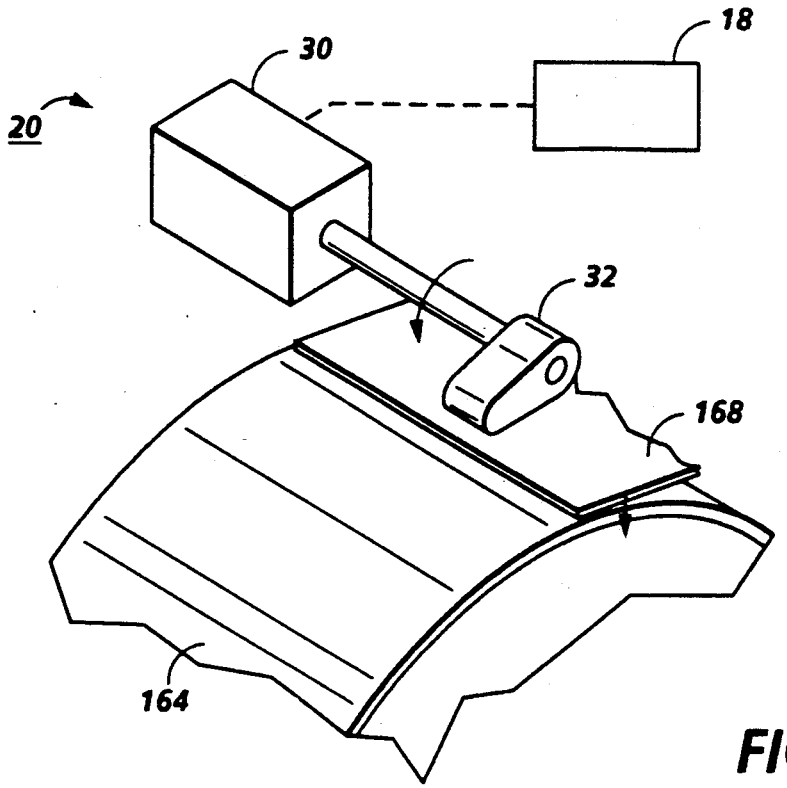
FIG. 5 is an elevational view of a device to vary the pressure of a metering blade against a developer roll.

In one embodiment of the present invention, the m/a of toner particles on the surface of developer roll 160 is a function of the pressure of metering blade 168 against the surface of developer roll 160. It follows that a high pressure $P_m$ of metering blade 168 on the metering surface of developer roll 160 will cause the layer of toner particles to become thinner, and thus create a smaller m/a. If it is desired to increase the m/a, it follows that the $P_m$ should be reduced so that the toner layer on developer rolls 160 can be increased. Once the control system determines the necessary level of pressure $P_m$ of the metering blade 168 against the sleeve 164 to create an appropriate m/a consistent with a desired q/m, the metering blade 168 can thus be controlled to exert the determined $P_m$ via metering blade 168. FIG. 5 is a simplified elevational view of one possible form of urging device 20. In the embodiment of FIG. 5, a voltage signal output as a result of function 18 may be used to control a small stepper motor 30, which in turn urges a cam 32 to apply the metering blade 168 against the sleeve 164 with a controlled force. Other devices, such as one employing a coil spring urging a member against metering blade 168, will be apparent to one skilled in the relevant art. The important consideration is to vary the $P_m$ to achieve the desired spacing to obtain the desired q/m.

Within certain ranges of m/a on the surface of sleeve 164, it may become necessary to compensate other parameters of the system so that a sufficient amount of toner particles having the desired q/m are ultimately placed on the photoreceptor 106. If, for example, the required q/m mandates a low value of m/a, more area of the sleeve will be necessary to obtain a sufficient absolute amount (mass) of particles on the photoreceptor. Conversely, if the necessary q/m requires a high m/a, the toner particles will be spread thickly on the sleeve 164, and less area of the sleeve need be passed through the development zone between sleeve 164 and photoreceptor 106. These compensations can be attained by controlling the relative velocities of the adjacent surfaces of sleeve 164 ($V_{dev}$) and photoreceptor 106 ($V_{pr}$). The input of this function need be only the value of m/a; the output can be used to control the motors moving sleeve 164 and photoreceptor 106 according to the necessary value of $V_{dev}/V_{pr}$. The relationship within the entire system of the present invention is illustrated as box 20, interacting with developer roll 160 and photoreceptor 106, in FIG. 3.

Figure 6:
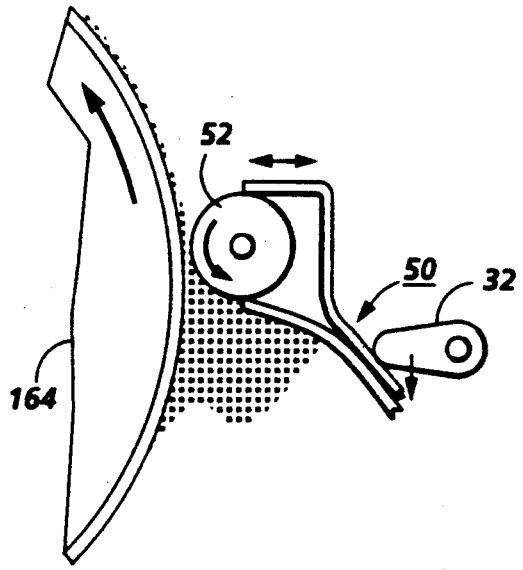
FIG. 6 is an elevational view of a device to vary the pressure of a charge rod against a developer roll.

FIG. 6 shows the use of a charge rod mechanism 50 for metering of toner particles on sleeve 164. In terms of metering particles, the charge rod 52 functions exactly like metering blade 168 in the above-described embodiments, but with the modification that charge rod 52 is connected to an external voltage source, as shown, in order to supply charge directly to toner particles coming in contact therewith. A fuller explanation of the function of the charge rod is given, for example, in U.S. Pat. No. 4,876,575 to Hays. It is possible to vary the charge imparted to the toner particles by varying the power to charge rod 52, or varying the rotational velocity of charge rod 52 relative to that of the photoreceptor, as well as by varying the m/a as according to the present invention. In charge rod mechanism 50 as shown, the charge rod 52 is mounted on a compliant arm 54, and is typically in a self-spacing relationship with the sleeve 164; that is, compliant arm 54 urges charge rod 52 against sleeve 164, and the passage of toner between them at a given rate results in a certain m/a. Although the charge rod mechanism 50 directly supplies charge to the toner particles, the charging action of the charge rod 52 is simply complementary to the principle that q/m is a unique function of m/a on the sleeve; the external addition of charge simply changes the characteristics of the equation relating m/a to q/m for given conditions. Thus, the metering properties of the charge rod mechanism 50 are conductive to control according to the system of the present invention. As shown in FIG. 6, a cam 32, homologous to cam 32 in the metering-blade embodiment shown in FIG. 5, can be used to control the $P_m$ of the charging rod 52 against sleeve 164.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An apparatus for maintaining a selected ratio of electrostatic charge per unit mass for particles adhering to a member transporting to a surface having a latent image recorded thereon, comprising:

means for controlling a ratio of particle mass to the member surface area; and means for adjusting the controlling means as a function of the selected ratio of electrostatic charge to unit mass to regulate the ratio of particle mass to the member surface area so as to substantially maintain particle electrostatic charge to unit mass ratio at the selected ratio of electrostatic charge to unit mass.

2. An apparatus as in claim 1, wherein the controlling means is a metering member.

3. An apparatus as in claim 2, wherein the metering member is a metering blade.

4. An apparatus as in claim 2, wherein the metering member includes a rotatable rod.

5. An apparatus as in claim 2, wherein the controlling means adjusts the pressure of the metering member aginst the surface.

6. An apparatus as in claim 1, wherein the adjusting means comprises charge detection means for determining the ratio of particle electrostatic charge to unit of mass.

7. An apparatus as in claim 6, wherein the adjusting means comprises means for comparing the detected ratio of particle electrostatic charge to unit of mass to the selected ratio of particle electrostatic charge to unit of mass.

8. A method for maintaining a selected ratio of electrostatic charge per unit mass for particles adhering to a member transporting to a surface having a latent image recorded thereon, comprising the steps of:

controlling a ratio of particle mass to the member surface area; and adjusting the ratio of particle mass to the member surface area as a function of the selected ratio of electrostatic charge to unit mass to regulate the ratio of particle mass to the member surface area so as to substantially maintain particle electrostatic charge to unit mass ratio at the selected ratio of electrostatic charge to unit mass.

9. A method as in claim 8, wherein the ratio of particle mass to the member surface area is controlled by a metering member.

10. A method as in claim 9, wherein the metering member is a metering blade.

11. A method as in claim 9, wherein the metering member includes a rotatable rod.

12. A method as in claim 9, wherein the controlling step includes the step of adjusting the pressure of the metering member aginst the surface.

13. A method as in claim 8, further comprising the step of determining the ratio of particle electrostatic charge to unit of mass.

14. A method as in claim 13, further comprising the step of comparing the detected ratio of particle electrostatic charge to unit of mass to the selected ratio of particle electrostatic charge to unit of mass.

* * * * *